US006354205B1

(12) United States Patent
Reichel

(10) Patent No.: US 6,354,205 B1
(45) Date of Patent: Mar. 12, 2002

(54) PRINTING PLATE AND PROCESS FOR PRODUCING

(75) Inventor: Klaus T. Reichel, Augsburg (DE)

(73) Assignee: MAN Roland Druckmaschinen AG, Offenbach am Main (DE)

( * ) Notice: Subject to any disclaimer, the term of this patent is extended or adjusted under 35 U.S.C. 154(b) by 0 days.

(21) Appl. No.: 09/527,366

(22) Filed: Mar. 17, 2000

(30) Foreign Application Priority Data

Mar. 17, 1999 (DE) ..... 199 11 821

(51) Int. Cl.[7] ..... B41N 1/10; B41C 1/00

(52) U.S. Cl. ..... 101/401.1; 101/395; 101/463.1; 83/75.5; 29/417

(58) Field of Search ..... 101/453, 454, 101/458, 459, 463.1, 467, 368, 395, 401.41, 401.2; 29/33 H, 417; 83/75.5

(56) References Cited

U.S. PATENT DOCUMENTS 4,643,094 A * 2/1987 Holmström ..... 101/401.1
5,038,648 A * 8/1991 Hiraoka ..... 83/160

FOREIGN PATENT DOCUMENTS

| | | |
|---|---|---|
| DE | 252 799 | 9/1986 |
| EP | 0 470 529 | 8/1991 |
| NL | 7313468 | 10/1973 |

* cited by examiner

*Primary Examiner*—Leslie J. Grohusky
(74) *Attorney, Agent, or Firm*—Cohen, Pontani, Lieberman & Pavane

(57) ABSTRACT

A printing plate made of rolled sheet metal strip for extra-wide machines with an increased service life is made having a length and width arranged obliquely to the rolling direction of the sheet metal. A process for producing rectangular panels from rolled sheet metal strip with main directions running obliquely with respect to the rolling direction to produce such printing plates includes cutting the sides of the rectangular panels obliquely to the rolling direction of the sheet metal strip.

8 Claims, 6 Drawing Sheets

PRINTING PLATE AND PROCESS FOR PRODUCING

BACKGROUND OF THE INVENTION

1. Field of the Invention

The present invention relates to a printing plate made of rolled sheet metal and a process for producing printing plates from rectangular panels cut from a rolled sheet metal strip.

2. Description of the Related Art

Printing plates are rolled or placed on plate cylinders of printing machines. The edges at the circumferential ends of the printing plates are turned over and the turned over edges are received and clamped on the plate cylinders for holding the printing plate on the cylinder. One of the flat sides of the printing plate has a surface for receiving an image via printing technology. The surface which receives the image is grained, i.e., roughened or coated, and may also have a light-sensitive or laser sensitive covering.

The starting material for printing plates is a rolled sheet metal strip such as aluminum. The maximum width of a rolled sheet metal strip is limited by the capabilities of the rolling mills. Normal width printing plates may be cut from the sheet metal strips such that the circumferential edges of these normal width printing plates are transverse to the rolling direction of the strip. Accordingly, the turned over edges which are clamped are also transverse to the rolling direction. The sheet metal strip may already comprise a surface on which an image may be set. However, printing plates for extra-wide printing machines are wider than the width of rolled sheet metal strip. Therefore, when producing printing plates for extra wide machines, the extra-wide printing plates must be cut transverse with respect to the rolling direction because the width of these extra-wide printing plates exceeds the maximum strip width capabilities of rolling mills. A result of this configuration is that the turned over edges for extra wide printing plates are typically substantially parallel to the rolling direction of the sheet metal strip used to form the printing plate.

The crystal axes of rolled materials are aligned in the rolling plate and in the rolling direction. This alignment of the crystal axes produces an increased strength along the rolling direction. However, there is an increased tendency for tears to occur in the longitudinal direction. Because of this characteristic, extra wide printing plates are susceptible to fractures, especially at the turned over ends, after they have rolled over very few times during printing operations. Therefore, the service life of extra wide printing plates is significantly shorter than printing plates having a normal width.

SUMMARY OF THE INVENTION

The object of the invention is to provide an extra-wide printing plate having increased service life compared to the prior art and to provide a process for the production of the inventive extra-wide printing plates.

According to an embodiment of the present invention, the object is achieved by a printing plate in which a length and a width of the printing are arranged obliquely to the rolling direction of the sheet metal strip from which the printing plate is cut. As stated above, a rolled material has increased material strength along the rolling direction. Therefore, at least one component of the loading vector of the printing plate lies in the direction of increased material strength due to the oblique arrangement of the length and width. As a result, the service life of the printing plate is prolonged. Using the process according to the invention, it is possible to produce extra-wide printing plates with increased strength in the stress direction. Images of a number of pages can be set alongside one another on extra-wide printing plates. The resulting extra-wide printing plates are used on very wide printing machines, which process printing-material web widths of, for example, more than 1460 mm paper width.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Figure 1:
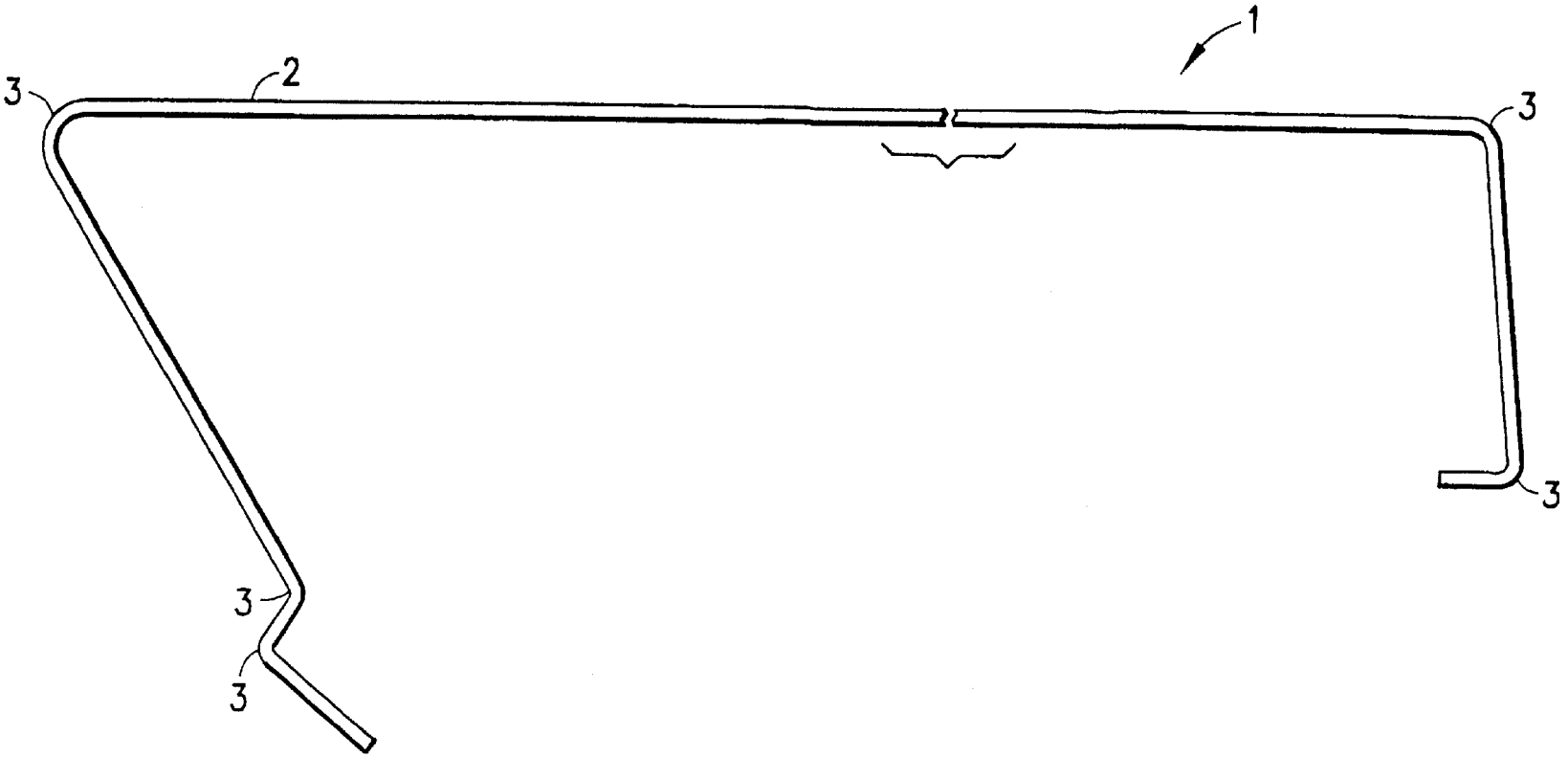
FIG. 1 is a side view of a printing plate according to an embodiment of the present invention.

FIG. 1 shows a printing plate 1, viewed from the side. A functional side 2 of the printing plate 1 extends into the plane of FIG. 1 and is arranged so that an image of the object to be printed may be set on it via printing technology. The ability to set the image on the functional side 2 may, for example, be obtained by providing a light-sensitive layer on the functional side 2 which, following exposure and development corresponding to the object to be printed, has ink-accepting and ink-repelling zones. However, laser technology, i.e., in the form of plate setters, may also be effectively used for this process. In addition, the same image setting effect may be achieved by roughening the functional sides to create grained surfaces. After setting the image on the printing plate 1, bent-over edges 3 arranged at the two longitudinal ends of the printing plate 1 are bent in the printing direction. At these bent-over edges 3, the printing plate 1 is held and clamped by equipment provided for this purpose after being rolled on or placed on a cylinder of a printing machine (the cylinder and clamping equipment are not shown).

Figure 2:
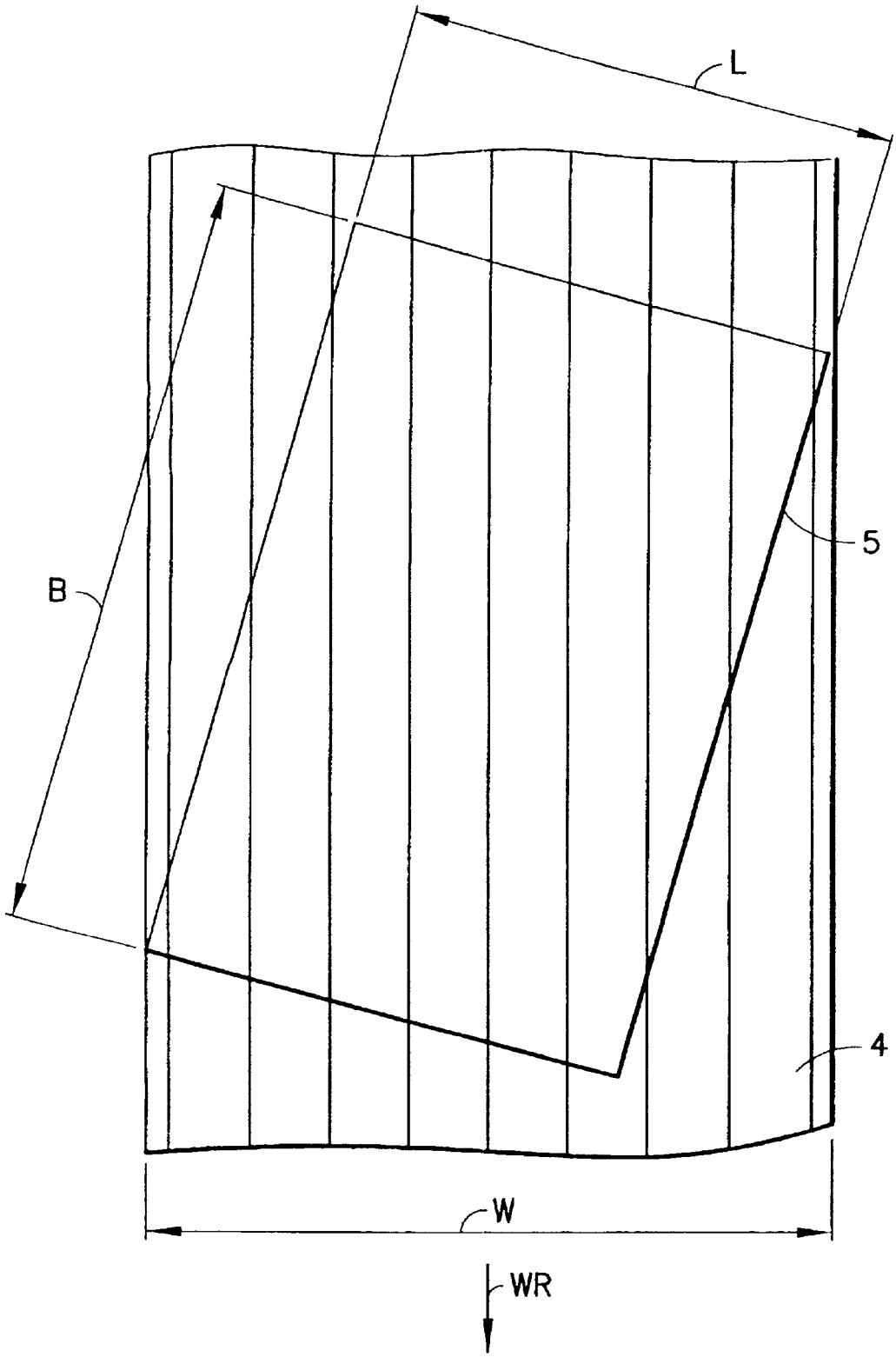
FIG. 2 is a plan view of a sheet metal strip showing the position of a panel from which a printing plate is formed.

Printing plates 1 are normally produced from plates in the form of panels 5 which have been cut out from a rolled sheet metal strip 4. FIG. 2 illustrates the alignment according to the invention of such a panel 5 on the sheet metal strip 4. The panel 5 has a width B and a calculated stretched length L and is located obliquely with respect to the longitudinal direction of the sheet metal strip 4, so that the rolling direction WR likewise runs obliquely with respect to the main directions of the panel 5. The term main directions is to be understood as the extent of the panel 5 in the directions of the width B and the length L. As the alignment of the length L approaches the rolling direction WR, the loading capacity of the printing plate 1 in the direction along the length L becomes greater. To optimize this loading direction, two diagonally opposite corners of the panel 5 are placed at the outermost edges of the strip width W of the sheet metal strip 4. The optimum is achieved when the strip width W is as great as the width B of the printing plate 1. This case arises in printing plates 1 of normal width.

Figure 3:
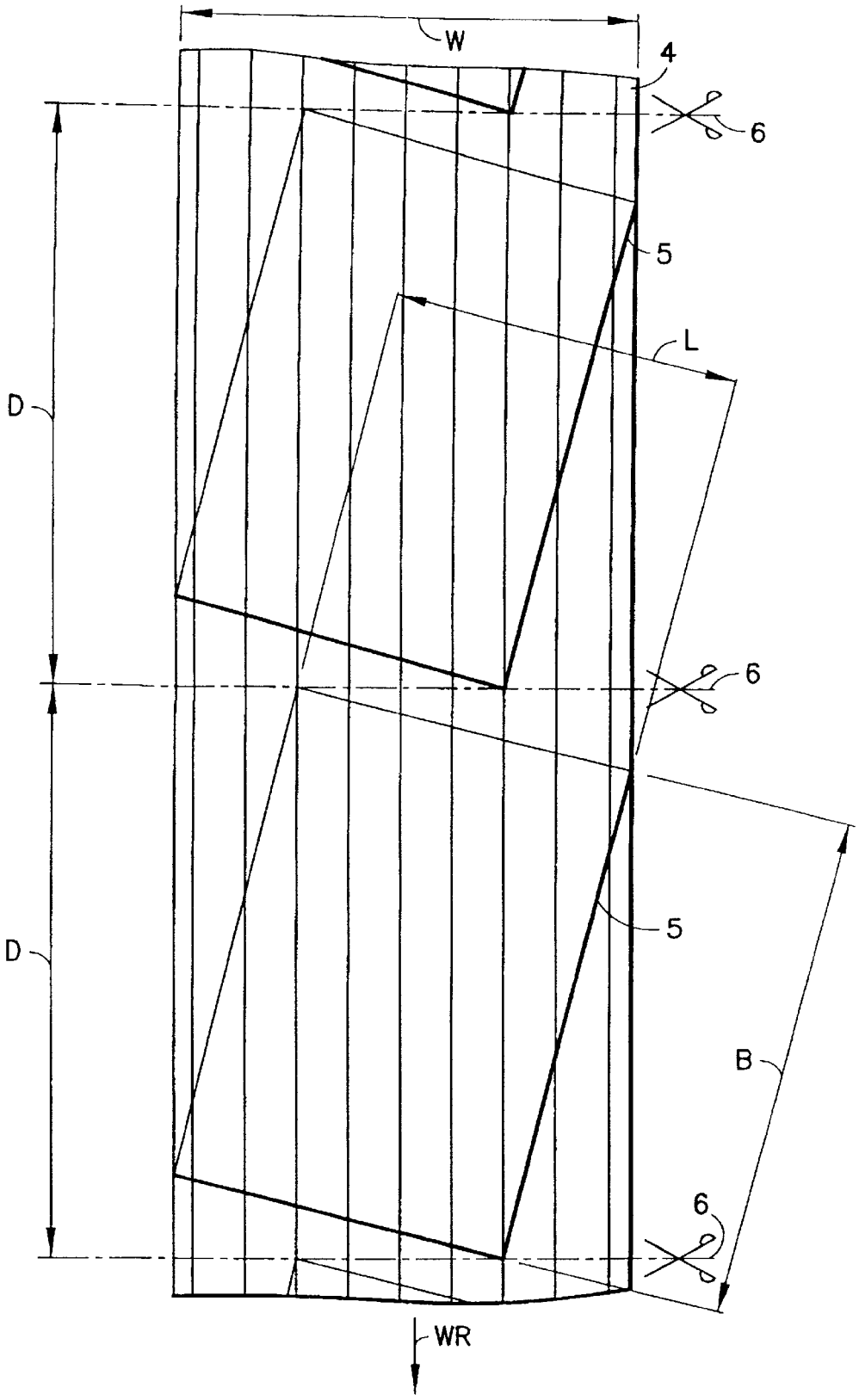
FIG. 3 is a plan view of a sheet metal strip showing an arrangement of panels to be cut from the sheet metal strip in accordance with a process according to the invention.

FIG. 3 shows the arrangement of two successive panels 5 on the sheet metal strip 4, such as is provided for a production process according to the present invention. The sheet metal strip 4 is divided into sections by a cutting process along cut lines 6 which are offset by the section length D. The section length D comprises the longitudinal length of the strip used by each panel 5. The foremost part of one panel 5 is aligned on the same transverse line, i.e., cut line 6, as the rearmost part of the next panel. Therefore, the cut line 6 goes through the corners located on the surface of the sheet metal strip 4 of two successive panels 5.

Figure 4:
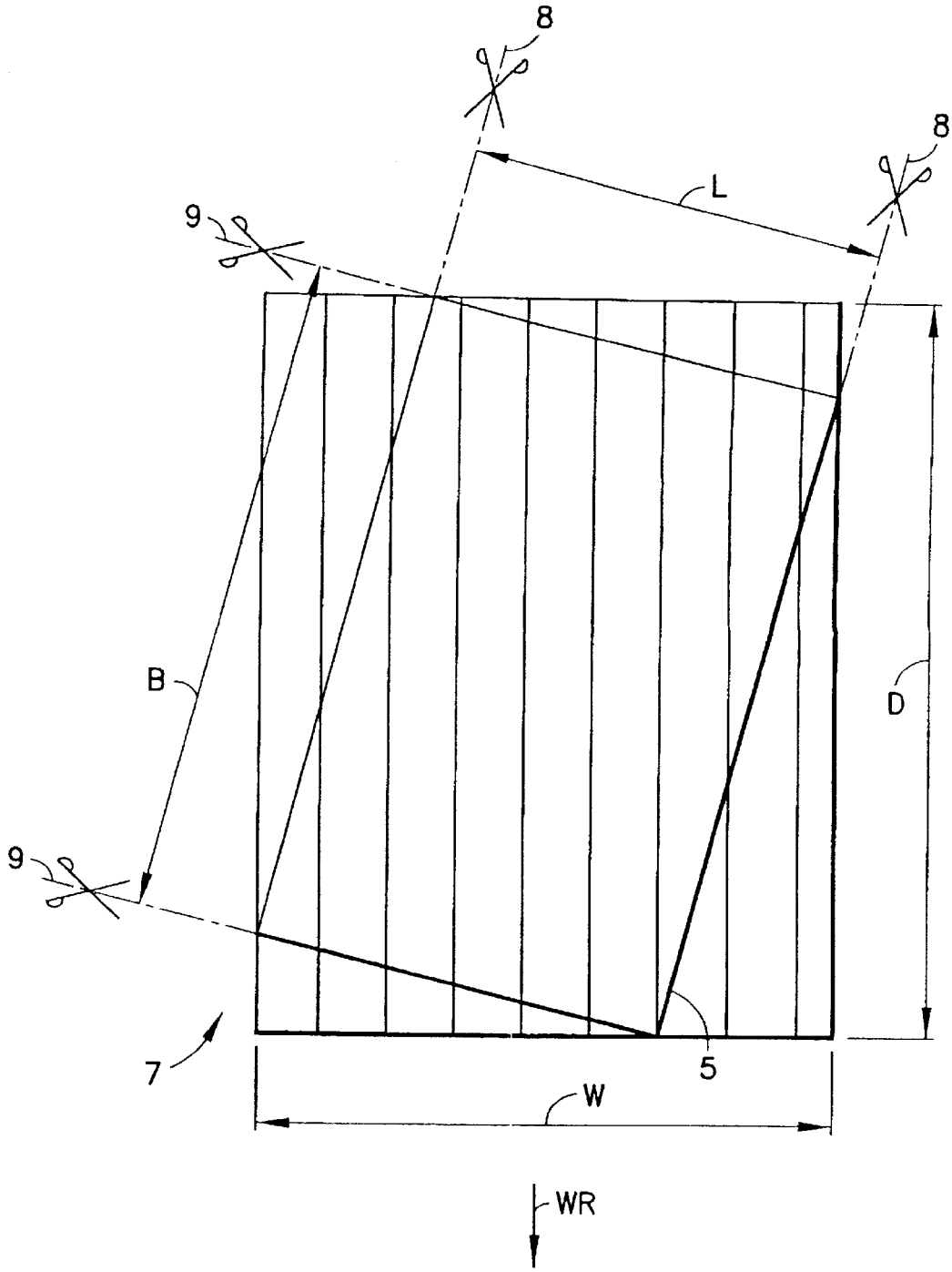
FIG. 4 is a plan view of an intermediate product from the process depicted in FIG. 3.

The intermediate product 7 produced in this process by cutting along cut lines 6 are illustrated in FIG. 4. These intermediate products 7 are rectangular with a strip width W as the first edge length and the section length D as the second length running at right angles thereto. The dimensions of the panels 5 in their oblique position with respect to the rolling direction WR are produced by cutting out along the cut lines 8, 9. This cutting operation may be effected via a stamping tool on a press. At the same time, register marks may also be made.

Figure 5:
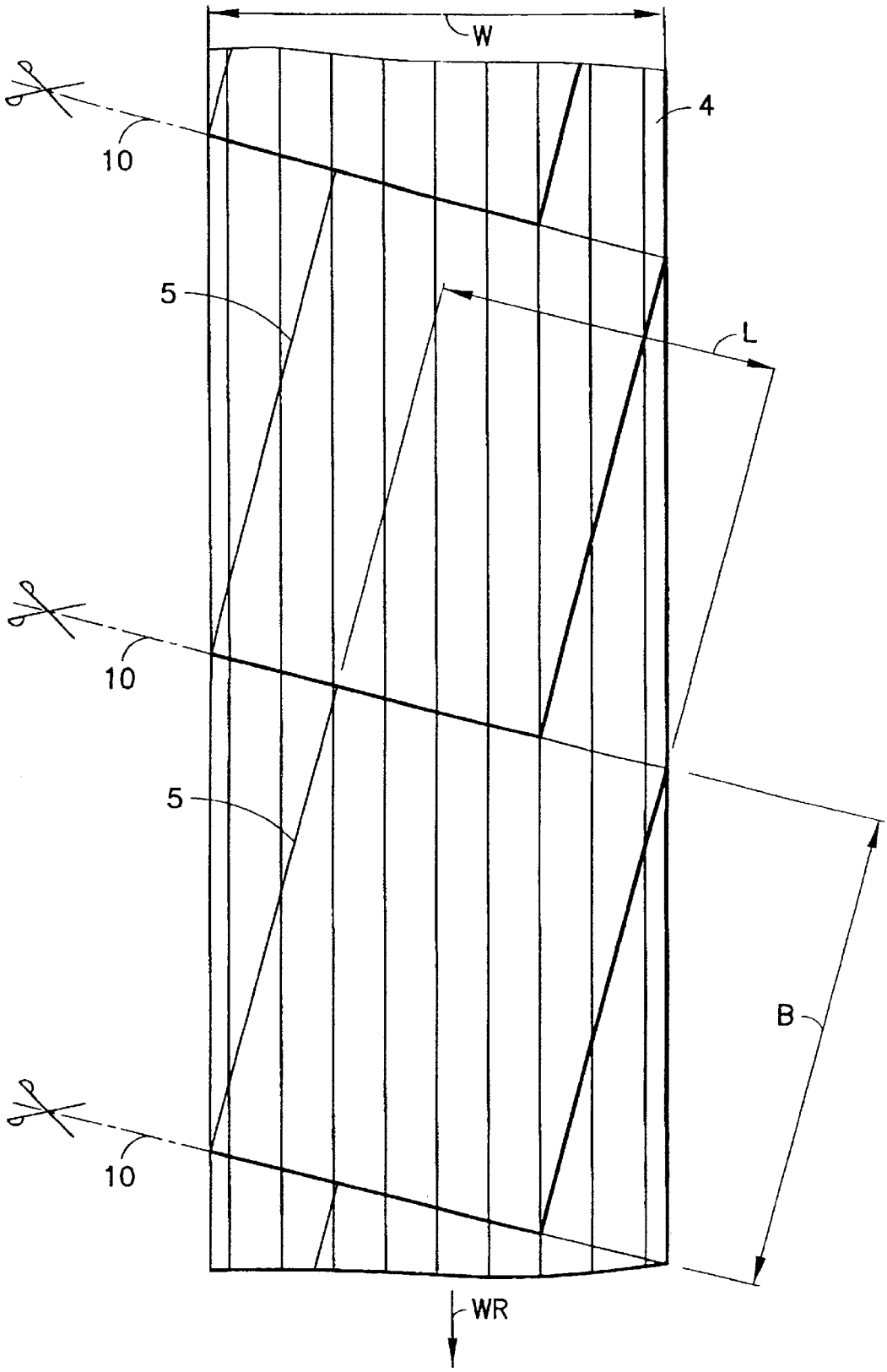
FIG. 5 is a plan view of a sheet metal strip showing an arrangement of panels to be cut from the sheet metal strip according to another process according to the invention.

FIG. 5 shows the procedure according to a further process according to the invention, in which the wastage of strip material is minimized and therefore the manufacturing costs are lower. In this process, the panels 5 are oblique with respect to the rolling direction WR of the sheet metal strip 4. However, in FIG. 5 the panels 5 follow one another without any offset in the longitudinal direction. This is achieved by oblique offset cuts along the cut lines 10, by means of which the width B of the printing plates 1 is already defined. In this process, both the angle of the cut line 10 and the pitch, that is to say the offset between the executed cuts, have to be coordinated with various oblique positions of different panels 5.

Figure 6:
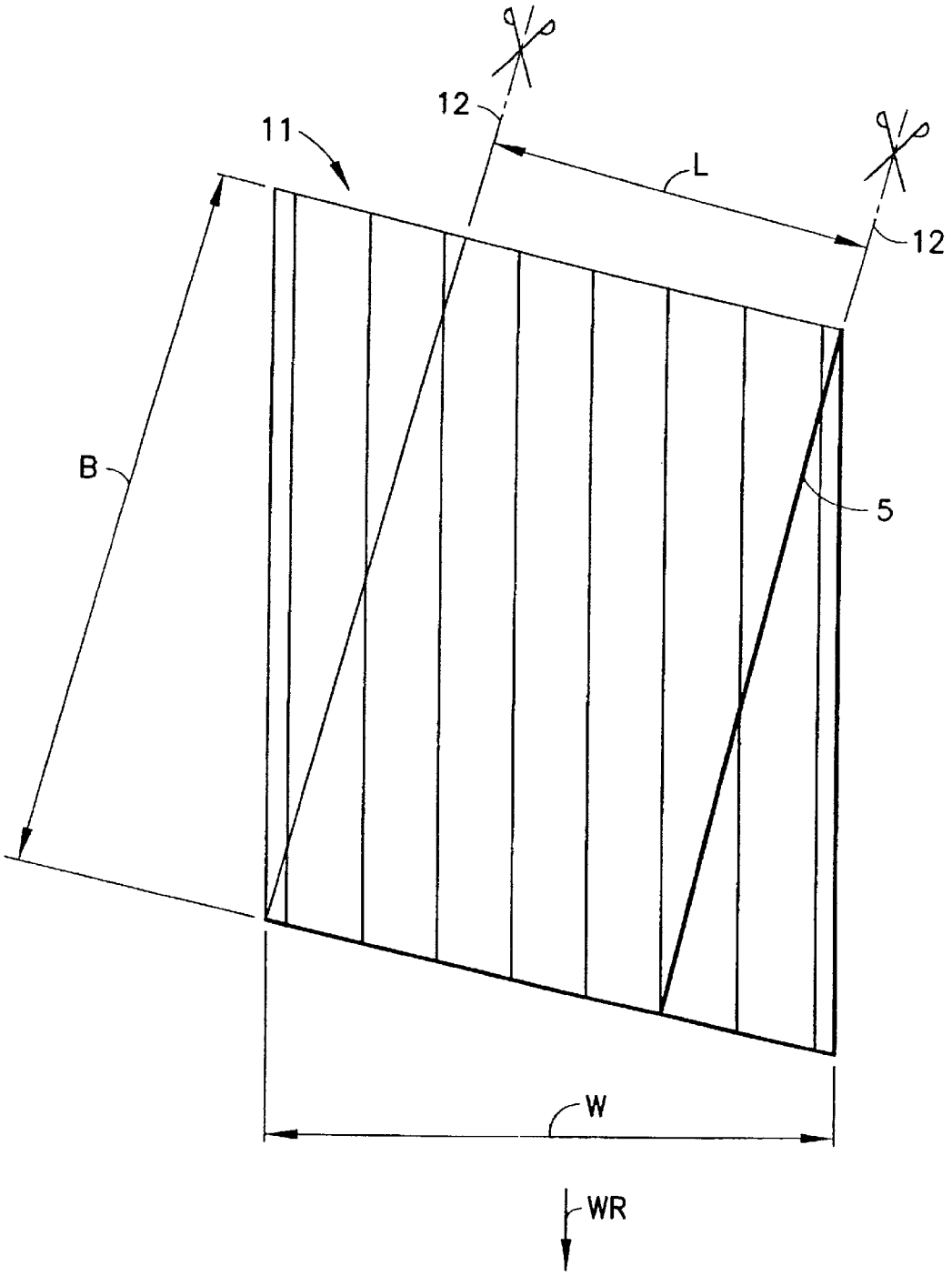
FIG. 6 is a plan view of an intermediate product from the process depicted in FIG. 5.

FIG. 6 illustrates an intermediate product 11 from the preceding process step described with reference to FIG. 5. These intermediate products 11 are parallelograms having a height corresponding to the strip width W. By trimming out the triangles projecting beyond the longitudinal ends of the panels 5 along the cut lines 12, the length L is finally produced. In this process, register markings may be stamped while the cuts are made along cut line 12.

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

I claim:

1. A printing plate comprising a section of rolled sheet metal strip having a rolling direction, wherein said printing plate has a length and width, said length of said printing plate being perpendicular to said width and wherein both said width and said length of said printing plate are arranged obliquely relative to said rolling direction of said rolled sheet metal strip.

2. The printing plate of claim 1, wherein said rolled sheet metal strip is a material selected from the group consisting of aluminium and an aluminium alloy.

3. The printing plate of claim 1, wherein said printing plate has a functional side comprising a surface on which an image may be set for a printing process.

4. The printing plate of claim 3, wherein said functional side of said printing plate comprises a layer selected from the group consisting of a light sensitive layer and a laser sensitive layer.

5. The printing plate of claim 3, wherein said surface of said functional side comprises a grained, roughened surface.

6. A process for producing rectangular panels for use as printing plates from a rolled sheet metal strip, comprising the steps of forming panels from the rolled sheet metal strip and machining the sides of the panels obliquely with respect to a rolling direction of the rolled sheet metal strip.

7. The process for producing printing plates of claim 6, wherein the step of forming comprises cutting sections of the rolled sheet metal strip at right angles to the rolling direction and the step for machining comprises machining the sides for one of the panels obliquely with respect to the rolling direction of the rolled sheet metal strip from each of the sections.

8. The process for producing printing plates of claim 6, wherein said step of machining the sides of the panels comprises making offset oblique cuts in the rolled sheet metal strip thereby producing a plate width of the panels and cutting at right angles to the offset oblique cuts to produce a length of the panels.

* * * * *